US006401368B1

(12) United States Patent
McLeod et al.

(10) Patent No.: US 6,401,368 B1
(45) Date of Patent: Jun. 11, 2002

(54) METHOD AND APPARATUS FOR EXCAVATING A TRENCH

(76) Inventors: James A. McLeod, Box 6, Vassar, Manitoba (CA), R0A 2J0; Murray Pisony, Box 87, Lundbreck, Alberta (CA), T0K 1H0

( * ) Notice: Subject to any disclaimer, the term of this patent is extended or adjusted under 35 U.S.C. 154(b) by 0 days.

(21) Appl. No.: 09/768,788

(22) Filed: Jan. 25, 2001

(51) Int. Cl.[7] ..... B66C 3/02; E02F 3/413; E02F 5/22

(52) U.S. Cl. ..... 37/142.5; 37/461

(58) Field of Search ..... 37/461, 188, 142.5, 37/379, 380; 405/179

(56) References Cited

U.S. PATENT DOCUMENTS

| | | | | |
|---|---|---|---|---|
| 3,463,336 A | 8/1969 | Mork | 214/138 |
| 4,077,140 A | 3/1978 | Branconi | 37/103 |
| 4,314,622 A | 2/1982 | Lindquist | 182/2 |
| 4,403,429 A | 9/1983 | Haringer | 37/103 |
| 4,523,684 A | 6/1985 | Baisden | 212/175 |
| 5,054,990 A | 10/1991 | Schaeff | 414/694 |
| 5,625,967 A | 5/1997 | Kulle | 37/443 |

*Primary Examiner*—Christopher J. Novosad
(74) *Attorney, Agent, or Firm*—Ryan W. Dupuis; Adrian D. Battison; Michael R. Williams

(57) ABSTRACT

An excavator and a method of use of the excavator is provided for use in excavating a trench having a pipeline extending along one side thereof in a longitudinal direction of the trench. The excavator is positioned adjacent the pipeline opposite the trench and includes a hydraulic arm arranged to extend over the pipeline and into the trench. A hydraulic clam bucket is mounted on a free end of the hydraulic arm for excavating earth from the trench. The arm includes articulation joints about both horizontal and vertical axes such that the base of the excavator adjacent the pipeline may remain fixed in relation to the pipeline as the bucket is guided within the trench.

19 Claims, 2 Drawing Sheets

METHOD AND APPARATUS FOR EXCAVATING A TRENCH

FIELD OF THE INVENTION

The present invention relates to a method and apparatus for excavating a trench and more, particularly for excavating a trench having an obstacle extending along one side thereof.

BACKGROUND

When assembling an underground pipeline a trench is typically first excavated wherein the excavated dirt from the trench is piled along one side the trench. The pipeline may then be assembled above ground along the other side of the trench opposite the excavated dirt. Once the pipeline has been assembled various lifting equipment is used to place the pipeline into the trench as the equipment is displaced in a longitudinal direction of the trench.

Typically when laying the pipeline into the trench, further excavation of the trench is required to remove water and dirt which has accumulated in the trench while the pipeline was assembled. Conventional hydraulic excavating equipment cannot be used however as typical backhoes and the like are not able to reach over the pipeline into the trench once the pipeline has been assembled. The use of a crane having a cable operated bucket is thus known to be used. Cranes however are difficult to guide and typically require a second operator located near the trench to guide the bucket. Furthermore operators of such equipment are difficult less common than operators of modern conventional hydraulic excavating equipment.

SUMMARY

According to one aspect of the present invention there is provided a method of excavating a trench having a pipeline extending in a longitudinal direction of the trench along one side of the trench, the method comprising:

providing an excavator having a base supported for movement across the ground in a forward working direction, an extension arm mounted on the base, a lift arm pivotally mounted on the extension arm for pivotal movement about an upright axis, a working arm pivotally mounted on the lift arm for pivotal movement about a generally horizontal axis and an excavating bucket mounted on a free end of the working arm;

locating the excavator on one side of the pipeline opposite the trench with the forward working direction being oriented generally parallel to the longitudinal direction of the trench;

positioning the extension arm to extend from the base laterally over the pipeline transversely to the forward direction;

pivoting the lift arm in relation to the extension arm until the excavating bucket is aligned with the trench;

lowering the excavating bucket into the trench; and excavating earth from the trench using the excavating bucket.

The present invention provides a hydraulic arm which can be operated similarly to conventional hydraulic equipment. The articulations of the arm about a generally horizontal axis as well as an upright axis permit the arm to be aligned with the trench when reaching over a pipeline without the need to rotate the base of the excavator which is positioned adjacent the pipeline in use to prevent possible damage to the pipeline.

The method preferably includes displacing the excavator in the forward working direction alongside the pipeline.

Preferably the method also includes dumping the earth excavated from the trench along a side of the trench opposite the pipeline.

It is preferred that the excavating. bucket comprise a clam bucket having a pair of confronting shovels. In this instance the method may include providing a hydraulic operating mechanism for controlling the bucket and actuating the hydraulic operating mechanism to excavate earth from the trench.

The excavator may include an operator cab on the base having a lift mechanism arranged to displace the cab in relation to the base with the method including raising the cab upwardly over the pipeline and the extension arm. The method may further include raising the cab laterally outwards over the pipeline towards the trench.

The method preferably includes restricting displacement of the extension arm as the lift arm is pivoted to align the excavating bucket with the trench.

A water pump may be arranged to pump standing water from the trench wherein the method includes grasping the water pump with the excavating bucket, lowering the water pump into the trench and pumping water from the trench.

The method may further include locating the water pump on the base, pivoting the lift arm to extend laterally inwardly toward the base and grasping the water pump on the base with the excavating bucket.

According to a further aspect of the present invention there is provided an excavator comprising:

a base supported for movement across the ground in a forward direction;

an extension arm mounted on the base, the extension arm being arranged to extend from the base transversely to the forward direction to an outer end spaced laterally outward from the base in a working position of the extension arm;

a lift arm mounted on the outer end of the extension arm for pivotal movement about an upright axis relative to the extension arm;

a working arm pivotally. mounted on the lift arm for pivotal movement about a generally horizontal axis relative to the lift arm; and a clam bucket mounted on a free end of the working arm, the clam bucket comprising first and second confronting shovels mounted for pivotal movement relative to one another between an open position in which the shovels are spaced apart and a closed position in which the shovels are located adjacent one another.

The combination of a hydraulic clam bucket with the articulated hydraulic arm described herein is particularly useful for excavating earth at a location spaced laterally from the vehicle on the opposite side of an obstacle, for example a pipeline. The clam bucket does not impose any excessive moments on the hydraulic arm supporting the bucket when digging into the earth as does a shovel-type bucket which is typically found on excavating equipment including backhoes and the like.

A hydraulic operating mechanism is preferably coupled to the clam bucket arranged to displace the shovels between the respective open and closed positions.

The clam bucket may be supported on the working arm for rotation about an upright axis through a range of 360 degrees of rotation.

The lift arm and working arm are preferably arranged to extend inwardly across the base with the clam bucket engaged on the base in a storage position.

In this instance there may be provided a water pump supported on the base such that the clam bucket is arranged to engage the water pump to be displaced by the lift arm and working arm.

The lift arm may be pivotal relative to the extension arm about the upright axis through a range of at least 300 degrees of rotation, but preferably through a range of 360 degrees of rotation.

There may be provided an operator cab supported on the base having a lift mechanism arranged to displace the cab in relation to the base upwardly and laterally outwardly in relation to the base.

The extension arm may be arranged to extend substantially horizontally outward from the base in the working position.

There may be provided a pivot base mounting the lift arm thereon for pivotal movement about the upright axis, the pivot base being supported on the extension arm for pivotal movement about a generally horizontal axis.

BRIEF DESCRIPTION OF THE DRAWINGS

In the accompanying drawings, which illustrate an exemplary embodiment of the present invention.

DETAILED DESCRIPTION

Figure 1:
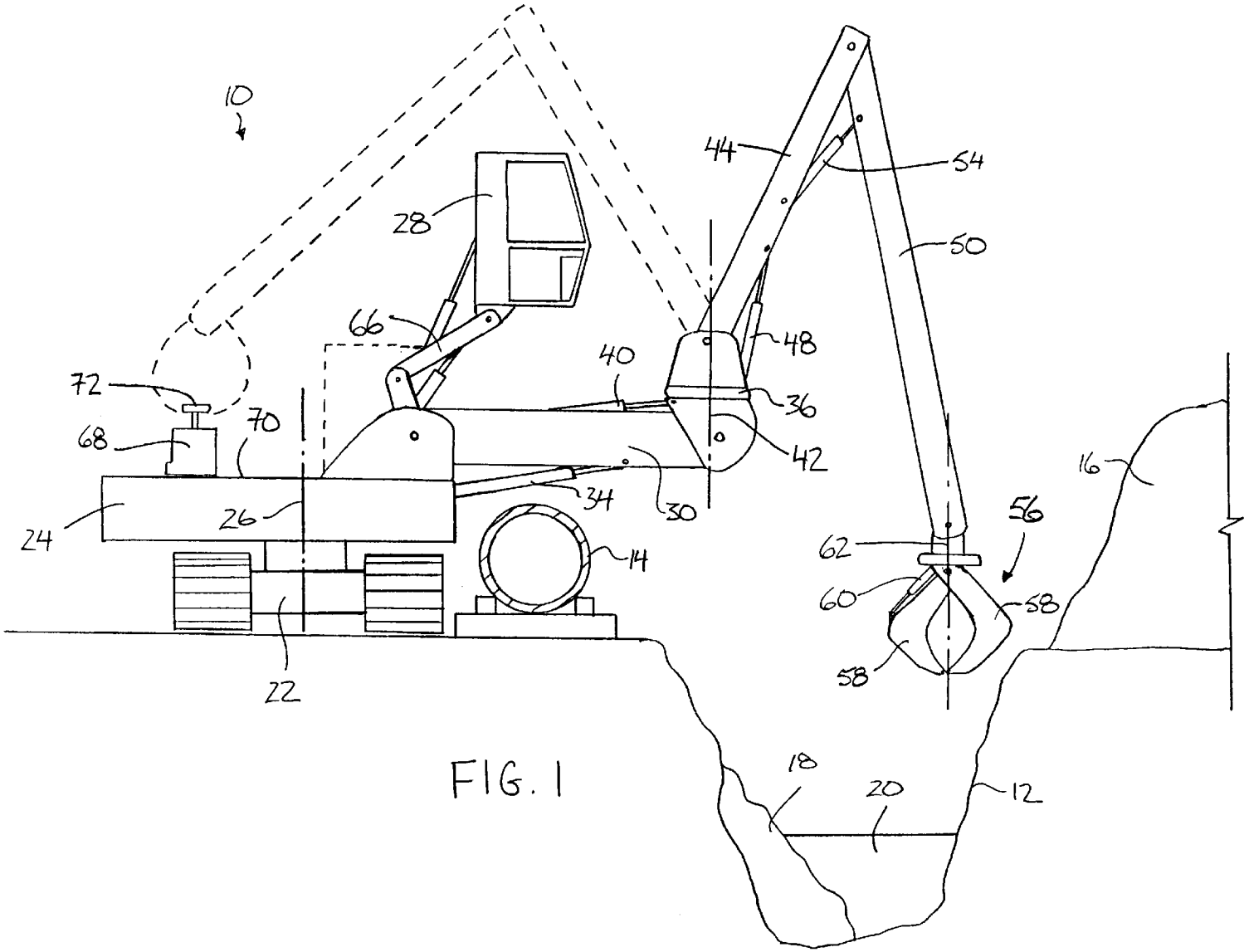
FIG. 1 is a side elevational view of the excavator in a working position extending over a pipeline for excavating a trench to receive the pipeline.
Figure 2:
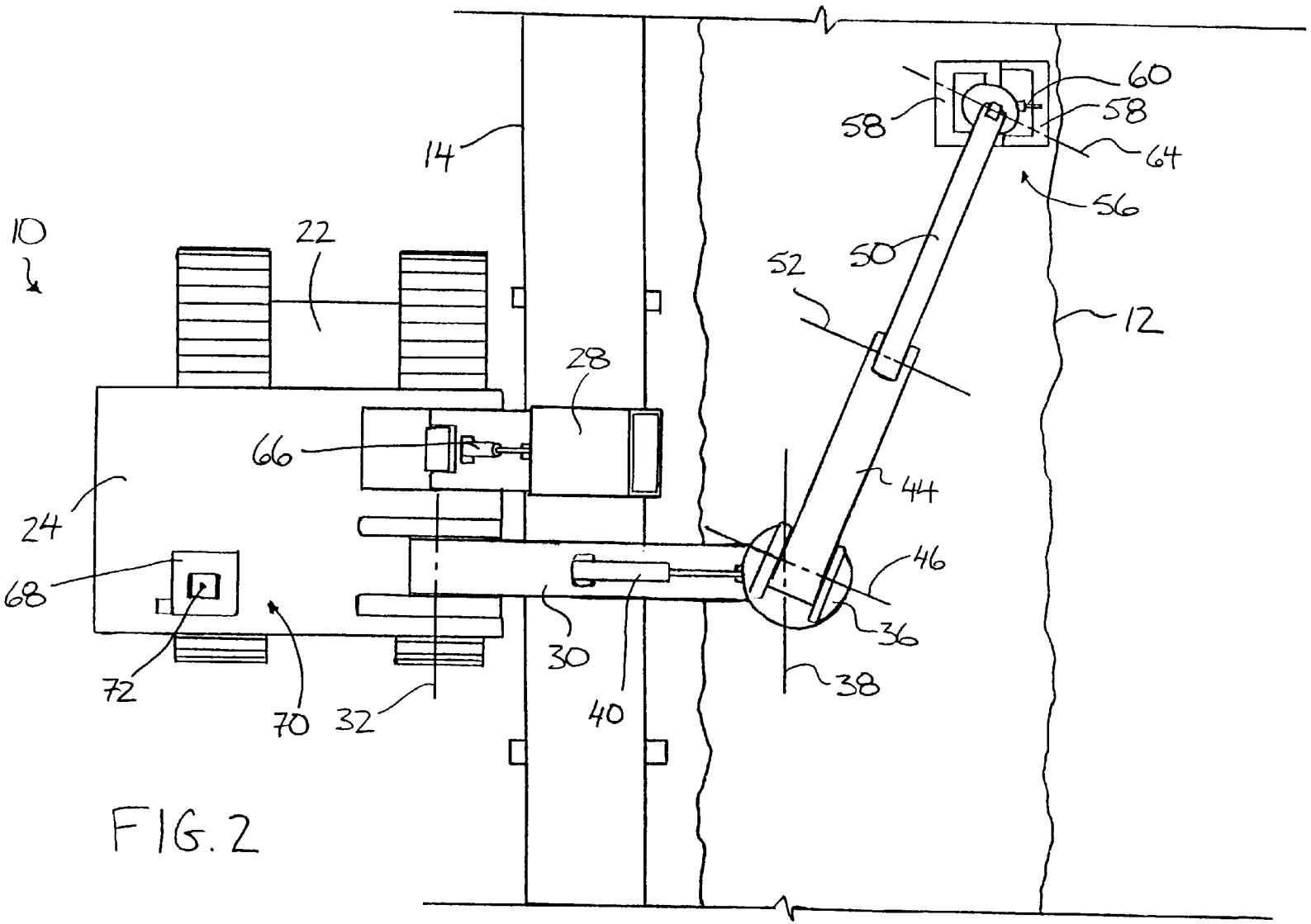
FIG. 2 is a top plan view of the excavator according to FIG. 1 with the lift arm shown pivoted in relation to the extension arm about an upright axis.

Referring to the accompanying drawings, there is illustrated an excavator generally indicated by reference numeral 10. The excavator is intended for use in excavating a trench 12 having a pipeline 14 extending along one side of the trench in a longitudinal direction of the trench.

The trench 12 for receiving the pipeline therein is typically formed with the excavated dirt 16 being located along one side of the trench so that the pipeline 14 can be assembled along the opposing side. Before the pipeline is placed in the trench, accumulated dirt 18 and water 20 is known to collect in the trench while the pipeline is being assembled and is required to be excavated from the trench before the pipeline is installed. The excavator 10 is arranged to clear the dirt and water collected in the trench.

The excavator 10 includes a tracked base 22 which is supported on the ground for rolling movement in a forward working direction along side the trench. A housing 24 is mounted on the tracked base for relative pivotal movement therebetween about a vertical axis 26. The housing includes an operator cab 28 and an extension arm 30 supported thereon.

The extension arm 30 is pivotally mounted on the housing 24 for relative pivotal movement about a horizontal axis 32. The extension arm 30 is further arranged to pivot about the vertical axis 26 with the housing 24. A hydraulic cylinder 34 controls the pivotal movement of the extension arm relative to the housing so that the extension arm 30 may be positioned to extend substantially horizontally and laterally outward over the pipeline 14 in a working position perpendicular to the forward direction and the longitudinal direction of the trench.

A pivot base 36 is mounted on an outer free end of the extension arm 30 for relative pivotal movement therebetween about a horizontal axis 38. A hydraulic levelling mechanism. 40 is coupled between the pivot base 36 and the extension arm 30 to ensure that an axis 42 of the pivot base remains substantially vertical regardless of the inclination of the extension arm 30 relative to the ground.

A lift arm 44 is mounted on the pivot base for rotation about the vertical axis 42 thereof. The lift arm 44 is pivotally supported on the pivot base for relative pivotal movement therebetween about a horizontal axis 46 as well. The orientation of the horizontal axis 46 pivots with the lift arm 44 about the vertical axis 42 of the pivot base upon actuation thereof. Movement of the lift arm is hydraulically controlled at the pivot base 36 and by a cylinder 48. The pivot base 36 is arranged to rotate the lift arm through a range of at least 300° of rotation and preferably a full 360° of rotation.

A working arm 50 is pivotally mounted on a free end of the lift arm 44 for relative pivotal movement therebetween about a horizontal axis 52. A hydraulic cylinder 54 coupled between the lift arm and the working arm controls the relative pivotal movement therebetween.

An excavating clam bucket 56 is mounted on the free end of the working arm 50. The clam bucket 56 comprises a pair of confronting shovels 58 which are mounted for relative pivotal movement therebetween between an open position in which the shovels are spaced apart in a closed position in which the shovels are engaged with one another. A hydraulic operating mechanism 60 is provided for controlling relative pivotal movement of the shovels 58. The bucket 56 is mounted for pivotal movement relative to working arm 50 about a vertical axis 62 and a respective horizontal axis 64. The bucket 56 is arranged to be fully rotatable about the vertical axis 62 through a range of 360 degrees of rotation.

The length of the lift arm and working arm in relation to the extension arm as well as the arrangement of the pivotal movement of the lift arm in relation to the pivot base permit the lift arm and working arm to be positioned to extend inwardly over the housing to engage the bucket 56 on the housing as shown in dotted line in FIG. 1. This is useful for storage or for collecting tools from the housing.

The cab 28 supported .on the housing is arranged to house an operator therein. A lift mechanism 66 supports the cab on the. housing and permits the cab to be lifted upwardly and laterally outwardly over the pipeline in a working position relative to the normal position indicated in dashed line in FIG. 1. The lift mechanism 66 is required to see over obstacles for example the pipeline 14, so that an extra person is not required to give the operator in the cab directions.

A water pump 68 is arranged to be supported on the deck 70 of the housing for use in pumping water from the trench. The pump includes a handle 72 extending upwardly therefrom which is arranged to permit the clam bucket to grasp the water pump and displace from the deck 70 to the trench.

In use the excavator 10 is located along side the pipeline 14 opposite the trench 12. The tracked base is oriented with the forward working direction being parallel to the pipeline for advancing the excavator along side the pipeline in the longitudinal direction of the trench. The housing 24 is pivoted in relation to the base 22 such that the extension arm 30 extends laterally over the pipeline in the working position thereof.

An operator may then raise the cab 28 upwardly and laterally outwardly over the pipeline up to the edge of the trench so as to be able to see down into the trench for excavating earth therefrom. The lift arm 44 may then be pivoted about its respective vertical axis 42 to align the bucket with the trench. While the bucket is being positioned within the trench, pivotal movement of the housing relative to the base is restricted to prevent the housing from colliding with and damaging the pipeline.

The bucket may further be positioned within the trench by advancing the excavator in the forward direction along side the trench as required. Earth is excavated from the trench by lowering the bucket and hydraulically opening and closing the bucket as required. Once the earth has been excavated from the trench it is dumped along side the trench opposite the pipeline so as not to interfere with the moving and lifting equipment used to place the pipeline in the trench.

When it is desired to clear water from the trench the lift arm and work arm are pivoted rearwardly as shown in dotted line in FIG. 1 so that the water pump supported on the deck of the housing may be grasped by the bucket and subsequently lowered into the trench. Once pumping of the water from the trench has been completed the water pump may once again be stored on the deck of the housing so as not to be left behind on the ground as the excavator is advanced along side the trench in the forward working direction.

While one embodiment of the present invention has been described in the foregoing, it is to be understood that other embodiments are possible within the scope of the invention. The invention is to be considered limited solely by the scope of the appended claims.

What is claimed is:

1. A method of excavating a trench having a pipeline extending in a longitudinal direction of the trench along one side of the trench, the method comprising:

providing an excavator having a base supported for movement across the ground in a forward working direction, an extension arm mounted on the base, a lift arm pivotally mounted on the extension arm for pivotal movement about an upright axis, a working arm pivotally mounted on the lift arm for pivotal movement about a generally horizontal axis and an excavating bucket mounted on a free end of the working arm;

locating the excavator on one side of the pipeline opposite the trench with the forward working direction being oriented generally parallel to the longitudinal direction of the trench;

positioning the extension arm to extend from the base laterally over the pipeline transversely to the forward direction;

pivoting the lift arm in relation to the extension arm until the excavating bucket is aligned with the trench;

lowering the excavating bucket into the trench;

excavating earth from the trench using the excavating bucket; and displacing the excavator in the forward working direction alongside the pipeline.

2. The method according to claim 1 wherein the method includes dumping the earth excavated from the trench along a side of the trench opposite the pipeline.

3. The method according to claim 1 wherein the excavating bucket comprises a clam bucket having a pair of confronting shovels.

4. The method according to claim 3 wherein the method includes providing a hydraulic operating mechanism for controlling the bucket and actuating the hydraulic operating mechanism to excavate earth from the trench.

5. The method according to claim 1 wherein the excavator includes an operator cab on the base having a lift mechanism arranged to displace the cab in relation to the base and the method includes raising the cab upwardly over the pipeline and the extension arm.

6. The method according to claim 5 wherein the method includes raising the cab laterally outwards over the pipeline towards the trench.

7. The method according to claim 1 wherein the method includes restricting displacement of the extension arm as the lift arm is pivoted to align the excavating bucket with the trench.

8. The method according to claim 1 wherein the method includes providing a water pump arranged to pump standing water from the trench, grasping the water pump with the excavating bucket, lowering the water pump into the trench and pumping water from the trench.

9. The method according to claim 8 wherein the method includes locating the water pump on the base, pivoting the lift arm to extend laterally inwardly toward the base and grasping the water pump on the base with the excavating bucket.

10. An excavator comprising:

a base supported for movement across the ground in a forward direction;

an extension arm mounted on the base, the extension arm being arranged to extend from the base transversely to the forward direction to an outer end spaced laterally outward from the base in a working position of the extension arm;

a lift arm mounted on the outer end of the extension arm for pivotal movement about an upright axis relative to the extension arm;

a working arm pivotally mounted on the lift arm for pivotal movement about a generally horizontal axis relative to the lift arm; and a clam bucket mounted on a free end of the working arm, the clam bucket comprising first and second confronting shovels mounted for pivotal movement relative to one another between an open position in which the shovels are spaced apart and a closed position in which the shovels are located adjacent one another.

11. The excavator according to claim 10 wherein there is provided a hydraulic operating mechanism coupled to the clam bucket arranged to displace the shovels between the respective open and closed positions.

12. The excavator according to claim 10 wherein the clam bucket is supported on the working arm for rotation about an upright axis through a range of 360 degrees of rotation.

13. The excavator according to claim 10 wherein the lift arm and working arm are arranged to extend inwardly across the base with the clam bucket engaged on the base in a storage position.

14. The excavator according to claim 13 wherein there is provided a water pump supported on the base and the clam bucket is arranged to engage the water pump such that the water pump may be displaced by the lift arm and working arm.

15. The excavator according to claim 10 wherein the lift arm is pivotal relative to the extension arm about the upright axis through a range of at least 300 degrees of rotation.

16. The excavator according to claim 10 wherein the lift arm is pivotal relative to the extension arm about the upright axis through a range of 360 degrees of rotation.

17. The excavator according to claim 10 wherein there is provided an operator cab supported on the base having a lift mechanism arranged to displace the cab in relation to the base upwardly and laterally outwardly in relation to the base.

18. The excavator according to claim 10 wherein the extension arm is arranged to extend substantially horizontally outward from the base in the working position.

19. The excavator according to claim 10 wherein there is provided a pivot base mounting the lift arm thereon for pivotal movement about the upright axis, the pivot base being supported on the extension arm for pivotal movement about a generally horizontal axis.

* * * * *